US006085447A

United States Patent [19]

Rose

[11] Patent Number: 6,085,447

[45] Date of Patent: Jul. 11, 2000

[54] TRENCHING TOOL

[76] Inventor: Loran Rose, 11817 S. Easley Dr., Lee's Summit, Mo. 64086

[21] Appl. No.: 09/149,502

[22] Filed: Sep. 8, 1998

[51] Int. Cl.[7] ..... E02F 3/96

[52] U.S. Cl. ..... 37/403; 37/407; 37/903

[58] Field of Search ..... 37/403, 468, 404, 37/407, 444, 903, 379, 380; 414/912; 248/223.41, 235, 250; 30/296.1; 172/245, 247

[56] References Cited

U.S. PATENT DOCUMENTS

| | | | |
|---|---|---|---|
| 1,716,432 | 6/1929 | Downie | 37/448 |
| 2,590,352 | 3/1952 | Sanner et al. | 37/347 |
| 2,783,558 | 3/1957 | Morgan | 37/403 |
| 3,305,951 | 2/1967 | Nunn | 37/367 |
| 3,349,933 | 10/1967 | Simpson et al. | 37/468 |
| 3,743,358 | 7/1973 | Guest | 37/117.5 |
| 3,908,844 | 9/1975 | Duffield | 214/145 |
| 4,009,529 | 3/1977 | Johnson | 37/117.5 |
| 4,068,771 | 1/1978 | Zimmerman | 214/313 |
| 4,085,530 | 4/1978 | Landry | 37/98 |
| 4,365,428 | 12/1982 | Shumaker | 37/103 |
| 4,550,512 | 11/1985 | Felstet | 37/117.5 |
| 5,833,008 | 11/1998 | Reed et al. | 171/141 |
| 5,901,479 | 5/1999 | Langdon | 37/444 |
| 5,906,243 | 5/1999 | Clausen | 172/33 |
| 5,909,961 | 6/1999 | Pullman | 37/444 |
| 5,918,389 | 7/1999 | Hall | 37/407 |

OTHER PUBLICATIONS

"Attachments for Loaders", Bobcat brochure B–1595, Melroe Company (Melroe #6724297).—no date.

"700 F–Series Skid–Steer Loaders", Bobcat brochure B–1669, Melroe Company.—no date.

"963 Skid–Steer Loader", Bobcat brochure B–1691, Melroe Company.—no date.

"873 Skid–Steer Loader", Bobcat brochure B–1677, Melroe Company.–no date.

"Bobcat 863 C–Series Skid–Steer Loader", brochure B–1687, Melroe Company.—no date.

"553 F–Series Skid–Steer Loader", Bobcat brochure B–1694, Melroe Company.—no date.

"400 D–Series Skid–Steer Loaders", Bobcat brochure B–1676, Melroe Company. —no date.

"Trencher", New Holland brochure 1995.

*Primary Examiner*—Robert E. Pezzuto
*Assistant Examiner*—Kristine M. Markovich
*Attorney, Agent, or Firm*—Chase & Yakimo, L.C.

[57] ABSTRACT

A trenching tool for releasable attachment to a bucket of a front end loader includes a pair of support brackets with a chute-like blade thereon. Each bracket includes a support arm for the blade and an integral shoulder brace portion for mounting underneath a surface of the bucket. The front edge of the bucket is received within a notch of each support bracket and is clamped thereto by a releasable upper clamp. Each support bracket includes a bearing surface for transferring forces acting on the tool to the underside of the bucket to enhance the tool's stability during use. The chute-like blade enables sod to be rolled up into the blade for deposit into the bucket upon an initial pass of the loader. Upon subsequent passes, entrenching is accomplished with the loosened dirt entering the chute for deposit into the bucket of the front end loader.

15 Claims, 1 Drawing Sheet

TRENCHING TOOL

BACKGROUND OF THE INVENTION

This invention relates to a trenching tool and, more particularly, to a trenching tool releasably attachable to a bucket of a front end loader or the like.

Various attachments have been designed to replace a bucket of a front end loader, such as a Bobcat or the like. These attachments include pallet forks, rakes, backhoes, augers, grapples and a hydraulically powered trenching tool. These known tools replace the bucket itself. The tools are relatively complex in construction, expensive and thus not cost effective for all users.

Accordingly, it is desirable to have a relatively inexpensive trenching tool which is easily attached to a bucket of a front end loader.

In response thereto I have provided a trenching tool which is releasably attached to the bucket of a front end loader. The tool includes a pair of brackets releasably engageable with the bucket which are designed to transfer forces exerted on the tool to the bucket. The tool includes a chute-type blade mounted atop a pair of support brackets such that sod can be first rolled up the chute and deposited into the bucket of the front end loader. Subsequently, the blade upon bucket and loader manipulation penetrates the earth at user selectable depths so as to dig a trench. During entrenching the dirt moves up the chute-type blade and into the bucket. The loader can then transport the dirt away from the trench without the need to remove the tool.

It is therefore a general object of this invention to provide a trenching tool which is releasably attached to the bucket of a front end loader.

Another object of this invention is to provide a trenching tool, as aforesaid, which directs sod and/or dirt into the bucket of a front end loader.

Another object of this invention is to provide a trenching tool, as aforesaid, which includes support brackets designed to dissipate the forces acting on the tool to the bucket of the front loader.

Still another object of this invention is to provide a trenching tool, as aforesaid, which is relatively inexpensive to manufacture and economical in cost.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
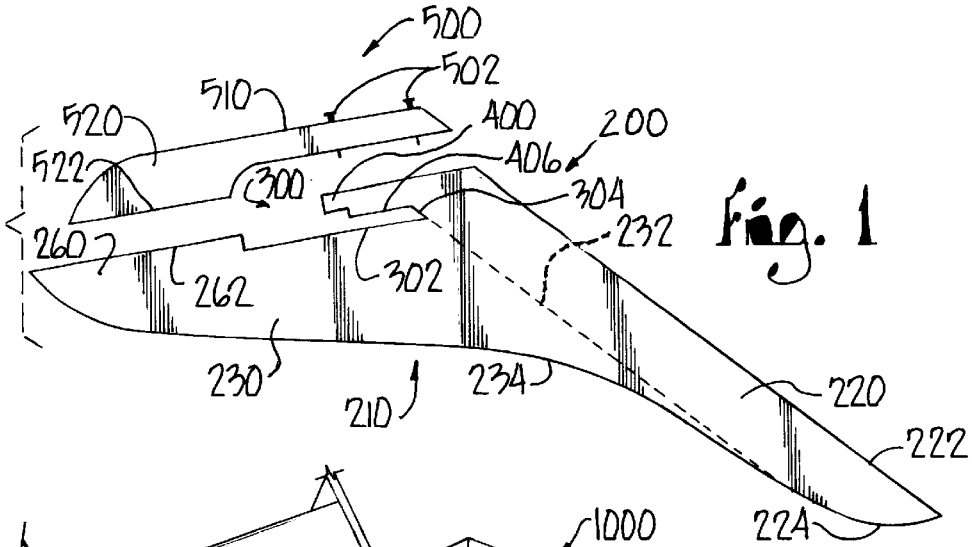
FIG. 1 is an exploded view of one support bracket of the trenching tool.
Figure 2:
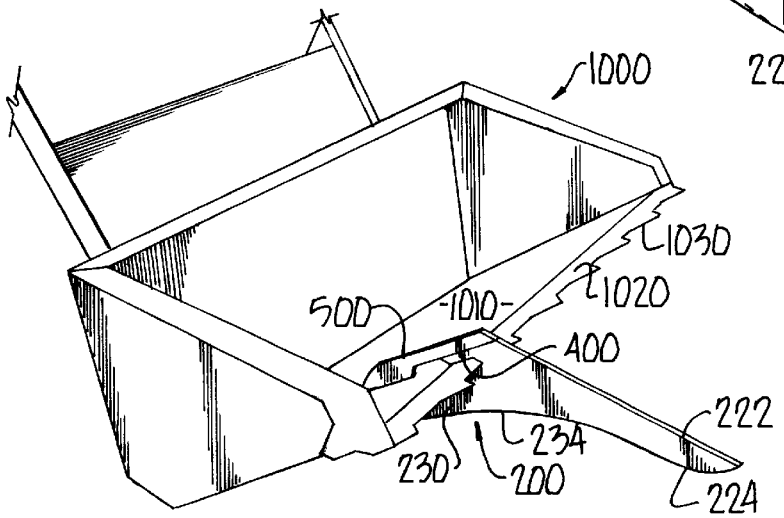
FIG. 2 shows the one support bracket of the entrenching tool, on a reduced scale, clamped to the bucket of a front end loader.
Figure 3:
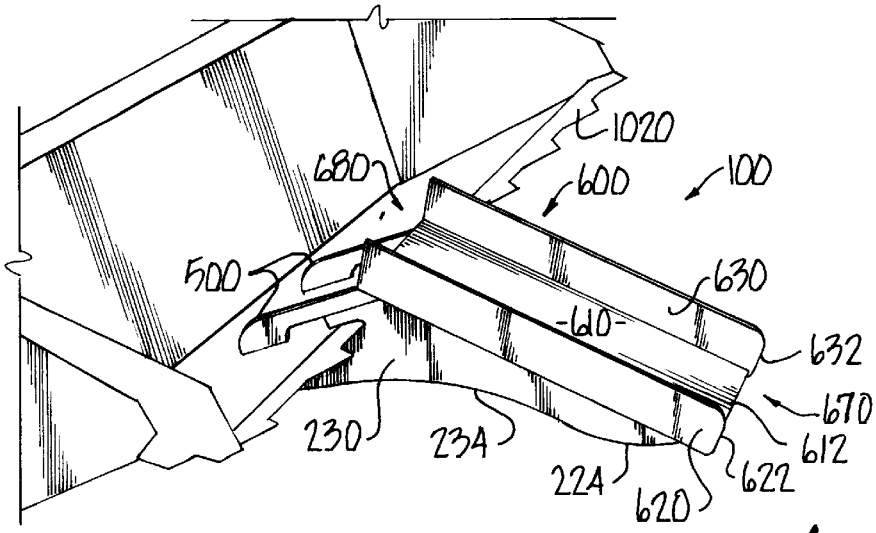
FIG. 3 shows the entire trenching tool releasably attached to the bucket of a front end loader.

Turning more particularly to the drawings, the tool 100 comprises a pair of laterally spaced-apart support brackets 200 (one shown) which are designed to be releasably attached/clamped to the front edge 1020 of the base 1010 of a bucket 1000 of a conventional front end loader.

Each bracket 200 includes a first support brace 210 presenting an elongated support arm 220 and an integral shoulder-like brace 230. Support arm 220 presents a longitudinal upper edge 222 and a lower edge 224 which joins a lower curvilinear edge 234 of the shoulder brace 230.

Integral with the support arm 220 is the shoulder brace 230 which includes the curvilinear edge 234. This edge 234 extends from an edge 262 of a bearing surface 260 of the shoulder and to the lower edge 224 of the support arm 220. As shown in the drawings, the distance between the upper edge 262 of the shoulder 232 and the curvilinear edge 234 generally increases as this curvilinear edge 234 extends from the rear of the upper edge 262 and the lower edge 224 of the support arm.

Adjacent the upper edge 262 of the bearing surface 260 is a notch 300. Notch includes a lower edge 302 and an upper edge 406 with an edge 304 therebetween. The notch 300 is configured to receive a portion of the earth penetrating front edge 1020 of the bucket 1000 therein. The notch 300 edge 304 bears against the front edge 1020 of the bucket when front edge 1020 is fully seated in the notch 300. As shown in FIG. 1, an imaginary extension of this front edge 304 is generally collinear with the lower Edge of the support arm 220 and approximately defines the juncture between the support arm 220 and shoulder portion 230.

Upon extension of the front edge 1020 of the bucket 1000 into the notch 300 the overlying edge 406 of a first/lower clamp portion 400 bears along a portion of a top side of the base 1010 of the bucket 1000. Also, the bearing surface 260 of the shoulder brace 230 bears against the underside of this bucket surface 1010. Accordingly, any downward forces acting on the support arm 220 will be transferred to the shoulder 230 and dissipated therealong by the relatively larger surface of the shoulder brace 230 extending from the arm 220. These forces are eventually directed to the bearing surface 260 and the underside of the bucket 1000.

Subsequent to engagement of the support brackets 200 with the bucket 1000 a second/upper clamp 500 is then releasably secured to the lower clamp 400 by fasteners 502. As shown, this upper clamp 500 includes an elongated arm 510 and a bearing surface 520 having a lower edge 522 which bears atop the surface 1010 of the bucket 1000 when in place. This bearing surface 522 is generally adjacent the underlying bearing surface 262 with the bucket 1000 surface 1010 therebetween. Accordingly, the upward forces acting on the support arm 200 are transferred along the support arm 200, the clamps 400, 500 and this bearing surface 522.

It is understood that a second bracket 200 is laterally spaced therefrom and is of identical construction. The brackets are preferably spaced so that the laterally adjacent teeth 1030 preclude lateral shifting of the tool 100 during use.

Atop the upper edge 222 of the spaced-apart support arms 200 is a chute-like blade 600. The blade 600 includes a base 610 with upstanding side walls 620, 630 extending therealong. The inlet end 670 of the chute 600 is defined by edges 612, 622, 632 which may be honed so as to enhance earth penetration. The blade 600 thus presents an inlet end 670 and outlet end 680.

Upon attachment by seating the bucket edge 1020 and fastening clamp 500 to clamp 400, the operator of the front end loader manipulates the bucket 1000 so that the inlet end 670 first penetrates the earth at a portion slightly below the sod level. Forward movement of the front end loader will then undercut the sod. The side walls 610, 620 of the chute 600 define the initial width of the trench. The channel-like structure of the chute 600 coupled with the forward movement of the front end loader will then cause the separated sod to roll up into the chute for deposit into the bucket 1000 via outlet 680. The sod may then be removed from the bucket 1000 by a worker.

Upon a subsequent pass, the front end loader operator further penetrates the front edge/inlet 670 of the chute 600 into the earth at a desired depth and makes another loader pass of the trench site. During forward movement of the loader, earth enters the inlet end 670 of the chute 600 and travels along the chute 600 for discharge out the outlet end 680 and into the bucket 1000 for subsequent deposit. The loader passes are repeated according to the desired depth of the trench. If the trench is to be wider than the width of the chute 600, repeated lateral passes using all or a portion of the chute 600 are then made. Upon the trench being dug, the tool 100 may then be removed. Subsequent to job completion the trench is then filled with the dirt by the bucket 1000 with the sod then unrolled therealong.

During use of the trenching tool 100, downward forces are being exerted on the chute 600 and support arms 200. These forces are first directed along the arms 200 and dissipated about the increased area of the shoulder brace 232 relative to arm 220. These forces are further directed to the bearing surface 260 of the shoulder brace 232 and to the underside of the bucket 1000. The bearing surface 260 is displaced away from the support arm 220 so as to diminish possibility of fracture of the tool at the arm 220/brace 232 juncture. Such forces are usually the greater forces arising during the entrenching process.

Forces acting upwardly on the arms 200, such as when the arms 220 hit a rock or the like, are likewise dissipated up the arms and along the clamps 400, 500 to the respective bearing surfaces 406, 522. These normally lesser forces are ultimately transferred to the relatively rigid top surface 1010 of the bucket 1000. The bearing surface 522 is greater than surface 406 so as to direct the forces away from the relatively smaller surface 406 at the front edge of the bucket. This action diminishes the possibility of fracture occurring along the top of the support arm 220 and clamp 400. Accordingly, the configuration of the tool 100 effectively dissipates forces acting thereon which enhances the stability of the mounted tool during use.

Subsequent to use the upper clamp 500 is removed from the underlying clamp 400 which allows the front edge 1010 of the bucket to be removed from the notch 300. Accordingly, it can be seen that the tool 100 is a cost-effective trenching tool which does not require the removal of the bucket 1000 during use.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. For attachment to a bucket of a front end loader, a trenching tool comprising:

an earth penetrating blade comprising:

a base having a front earth penetrating edge and a rear edge, said front edge presenting an inlet and said rear edge presenting an outlet;

a pair of brackets attached to said blade, each of said brackets comprising:

an elongated arm presenting an upper edge and a free lower edge, said upper edge supporting said base of said blade;

a shoulder brace portion integral with said arm, said shoulder brace portion including:

an upper edge adapted to present a bearing surface against an underside surface of the bucket of the loader at a first zone of contact displaced from a front edge of the bucket;

a notch in said upper edge of said shoulder brace portion adapted to receive the front edge of the bucket of the loader therein, a receipt of said bucket front edge in the notch positioning said upper edge of said shoulder brace portion in a bearing relationship against the underside surface of the bucket at said first zone of contact;

a first clamp extending from an end of said notch and spaced from said upper edge with said notch therebetween, said first clamp presenting a surface adapted to bear against a top side surface of the bucket at a second zone of contact adjacent the front edge upon said receipt of the bucket front edge in said notch;

a releasable second clamp comprising:

a generally elongated arm having first and second ends;

a bearing surface at said first end integral with said second clamp arm, said bearing surface of said second clamp adapted to bear against the top side surface of the bucket at a third zone of contact displaced from the front edge of the bucket upon an attachment of said second clamp to said first clamp;

means for releasably attaching said second end of said arm of said second clamp to said first clamp subsequent to said receipt of the bucket front edge in said notch for capping said notch, said attached second clamp positioning said bearing surface of said second clamp against the top side surface of the bucket generally opposite said upper edge of said shoulder brace portion bearing against the underside surface of the bucket, each said bracket extending said elongated arm beyond the front edge of the bucket to position said blade in an earth-penetrating position, said respective zones of contact of said respective bearing surfaces clamping said tool to the bucket without modification thereto, an operation of the front loader urging said inlet of said blade into the earth with a forward movement of the front loader entrenching the earth, the entrenched earth entering said blade at said inlet and exiting said blade at said outlet for deposit in the bucket.

2. The trenching tool as claimed in claim 1 wherein each shoulder brace portion further comprises a lower curvilinear edge extending between said upper edge of said shoulder brace and said lower edge of each bracket arm.

3. The trenching tool as claimed in claim 2 wherein said curvilinear edge is configured to present a generally increasing surface area between said upper edge of said shoulder brace and said curvilinear edge as said curvilinear edge extends from a juncture with said upper edge and towards said lower edge of said bracket arm.

4. The trenching tool as claimed in claim 1 wherein said notch includes a surface bearing against the bucket front edge upon said receipt of said bucket front edge in said notch.

5. The trenching tool as claimed in claim 4 wherein said bearing surface of said first clamp bears against the top side of the bucket surface adjacent the front edge upon said seating.

6. The trenching tool as claimed in claim 5 wherein an area of said zone of contact of said bearing surface of said second clamp is greater in area than an area of said zone of contact of said bearing surface of said first clamp to dissipate forces away from said first clamp bearing surface and the front edge of the bucket.

7. The trenching tool as claimed in claim 6 wherein said second clamp overlies said notch with the bucket front edge therein.

8. The trenching tool as claimed in claim 1 wherein said second end of said arm of said second clamp is larger than said first end of said arm to dissipate forces away from said first end and towards said second end of said arm.

9. For attachment to a bucket of a front end loader, a trenching tool comprising:

an earth penetrating blade comprising:

a base having a front earth penetrating edge and a rear edge;

at least one bracket attached to said base, said at least one bracket including:

an elongated support arm supporting said base;

a brace portion integral with said support arm, said brace portion including:

an upper edge adapted for bearing against an underside of the bucket of the loader;

a notch in said brace portion adjacent said upper edge adapted to receive a front edge of the bucket of the loader therein, a receipt of said bucket front edge positioning said upper edge of said brace portion in a bearing relationship against the underside of the bucket;

a first clamp portion extending from an end of said notch in said brace portion and presenting a surface bearing against a top side of the bucket upon said receipt of the bucket front edge in said notch;

a second releasable clamp including a bearing surface adapted for bearing against a top side of the bucket;

means for releasably attaching said second clamp to said first clamp upon the bucket front edge being positioned in said notch, said second clamp bearing surface bearing against the top side of the bucket with said upper edge of said brace portion bearing against the underside of the bucket opposite said second clamp bearing surface with said first clamp portion surface bearing against said top side of the bucket whereupon to clamp said tool to the bucket without modification thereto.

10. The trenching tool as claimed in claim 9 wherein said brace portion includes a lower edge extending between said upper edge of said brace and said support arm.

11. The trenching tool as claimed in claim 10 wherein said lower edge of said brace portion is configured to present a generally increasing surface area in said brace portion as said lower edge extends from said upper edge of said brace portion towards said support arm.

12. The trenching tool as claimed in claim 9 wherein said notch includes a surface bearing against the bucket front edge when seated in the notch.

13. The trenching tool as claimed in claim 9 wherein said bearing surface of said second clamp is greater than said bearing surface of said first clamp to dissipate forces away from said first clamp.

14. The trenching tool as claimed in claim 9 wherein an area of said second clamp adjacent said second clamp bearing surface is greater than an area of said first clamp adjacent said first clamp bearing surface to dissipate forces away from said first clamp.

15. For attachment to a bucket of a front end loader, a trenching tool comprising:

an earth penetrating blade having an inlet and an outlet, said inlet adapted to initially penetrate the earth;

at least one bracket attached to said blade, said at least one bracket comprising:

a support arm underlying said blade;

an integral brace portion adjacent said support arm, said brace including:

a surface adapted for bearing against the underside of the bucket of the loader;

a notch having a first end adjacent said bearing surface and a second end, said notch adapted to receive a front edge of the bucket of the loader therein, a receipt of said bucket front end in said notch positioning said bearing surface against the underside of the bucket;

a first clamp extending above said notch at said notch second end and presenting a surface adapted for bearing against the top side of the bucket upon said receipt of the bucket front edge in said notch;

a releasable second clamp comprising:

a first surface for attachment to said first clamp;

a bearing surface;

means for releasably attaching said first surface of said second clamp to said first clamp upon the bucket front edge being positioned in said notch, whereby to clamp said respective bearing surfaces of said first and second clamps against the top and bottom sides of the bucket, said at least one bracket clamped to the bucket presents said blade inlet end at a position extending beyond the front edge of the bucket, an operation of the front loader urging said blade into the earth for entrenching the earth upon a forward movement of the front loader, the entrenched earth entering said blade at said inlet end and exiting said blade at said outlet end for deposit in the bucket attached thereto.

* * * * *

UNITED STATES PATENT AND TRADEMARK OFFICE

CERTIFICATE OF CORRECTION

PATENT NO. : 6,085,447

DATED : July 11, 2000

INVENTOR(S) : Loran Rose

It is certified that error appears in the above-identified patent and that said Letters Patent is hereby corrected as shown below:

Column 3, line 20, delete "200" and substitute --220--.

Column 3, line 21, delete "200" and substitute --220--.

Column 3, line 30, delete "200" and substitute --220--.

Column 4, line 9, delete "said" and substitute --the--.

Column 4, line 50, after "brace" insert --portion--.

Column 4, line 54, after "brace" insert --portion--.

Column 5, line 47, after "brace" insert --portion--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*